US007296925B2

(12) United States Patent
Himmelsbach et al.

(10) Patent No.: US 7,296,925 B2
(45) Date of Patent: Nov. 20, 2007

(54) AGITATOR WITH IMPROVED BLADE CONFIGURATION

(75) Inventors: Werner Himmelsbach, Rheinfelden (DE); David Houlton, Lörrach (DE)

(73) Assignee: Ekato Rühr- und Mischtechnik GmbH, Schopfheim (DE)

( * ) Notice: Subject to any disclaimer, the term of this patent is extended or adjusted under 35 U.S.C. 154(b) by 133 days.

(21) Appl. No.: 10/841,939

(22) Filed: May 7, 2004

(65) Prior Publication Data

US 2004/0228210 A1 Nov. 18, 2004

(30) Foreign Application Priority Data

May 8, 2003 (DE) ..... 203 07 199 U

(51) Int. Cl.
*B01F 7/22* (2006.01)

(52) U.S. Cl. ..... 366/330.3

(58) Field of Classification Search .. 366/330.1–330.7, 366/262–265, 270; 261/84, 91, 119.1; 416/197 R, 416/235, 243
See application file for complete search history.

(56) References Cited

U.S. PATENT DOCUMENTS 1,011,259 A * 12/1911 Smith et al. ..... 416/185
1,473,066 A * 11/1923 Wells ..... 416/235
1,597,175 A * 8/1926 Boening ..... 416/235
1,827,225 A * 10/1931 Ferreby ..... 244/30
2,003,073 A * 5/1935 Faber ..... 416/231 R
2,028,413 A * 1/1936 Sackett ..... 34/435
2,384,952 A * 9/1945 Miller ..... 366/325.1
3,030,083 A * 4/1962 Stiffler ..... 416/199
3,147,958 A * 9/1964 Stiffler ..... 366/327.3
3,166,303 A * 1/1965 Chapman ..... 366/129
4,479,721 A * 10/1984 Rieger ..... 366/327.3
4,544,281 A * 10/1985 Wilkinson ..... 366/330.1
4,779,990 A * 10/1988 Hjort et al. ..... 366/102
4,896,971 A * 1/1990 Weetman et al. ..... 366/330.2
5,090,816 A * 2/1992 Socha ..... 366/293
5,198,156 A * 3/1993 Middleton et al. ..... 261/87
5,246,289 A * 9/1993 Middleton et al. ..... 366/270
5,316,443 A * 5/1994 Smith ..... 416/197 R
5,791,780 A * 8/1998 Bakker ..... 366/317
5,988,604 A * 11/1999 McWhirter ..... 261/91
6,190,033 B1 * 2/2001 Rickman et al. ..... 366/265
6,715,912 B2 * 4/2004 McWhirter et al. ..... 366/265
6,827,555 B2 * 12/2004 Yang ..... 416/197 R
6,860,631 B2 * 3/2005 McWhirter et al. ..... 366/265
6,866,414 B2 * 3/2005 Kupidlowski ..... 366/330.3
6,877,959 B2 * 4/2005 McWhirter ..... 416/228
6,896,246 B2 * 5/2005 Weetman et al. ..... 261/84
6,986,507 B2 * 1/2006 Weetman ..... 261/85
7,172,337 B2 * 2/2007 Roszczenko et al. ..... 366/270
2004/0113290 A1 * 6/2004 Weetman et al. ..... 261/91
2004/0174769 A1 * 9/2004 Weetman ..... 366/328.3
2004/0228210 A1 * 11/2004 Himmelsbach et al. .. 366/330.3

FOREIGN PATENT DOCUMENTS

GB 2249144 A * 4/1992
JP 7-275681 * 10/1995

* cited by examiner

*Primary Examiner*—Charles E. Cooley
(74) *Attorney, Agent, or Firm*—Henry M. Feiereisen; Ursula B. Day

(57) ABSTRACT

An agitator, in particular for dispersing gases in liquids, includes a plurality of blades, with each blade being constructed to have a blade portion bent forwards in a rotation direction. The blade has a trailing end region, which defines a blade portion bent forwards in a rotation direction, and a leading end region, which is bent inwards at an angle in a direction toward the blade portion.

24 Claims, 1 Drawing Sheet

AGITATOR WITH IMPROVED BLADE CONFIGURATION

CROSS-REFERENCES TO RELATED APPLICATIONS

This application claims the priority of German Patent Application, Serial No. 203 07 199.0, filed May 8, 2003, pursuant to 35 U.S.C. 119(a)-(d), the disclosure of which is incorporated herein by reference.

BACKGROUND OF THE INVENTION

The present invention relates, in general, to an agitator, in particular to an agitator for dispersing gases in liquids.

Agitators of a type involved here are used to disperse gas, supplied to a liquid being stirred, in smallest possible bubbles to create a large surface for a material transfer between gas and liquid.

It would be desirable and advantageous to provide an improved agitator which is constructed to shorten a mixing time while still keeping a drop in power to a minimum.

SUMMARY OF THE INVENTION

According to one aspect of the present invention, an agitator, in particular for dispersing gases in liquids, includes a plurality of blades, with each blade being constructed to have a blade portion bent forwards in a rotation direction. Suitably, the blade portion may be positioned at a trailing end of the blade, as viewed in rotation direction.

According to another feature of the present invention, the blade portion may be positioned at a radially outer zone of the blade.

According to another feature of the present invention, the ratio of the radial length of the blade portion to the radial length of the blade may be in a range of about 0.2 to 1.0, preferably about 0.4 to 0.6.

According to another feature of the present invention, the ratio of the width of the blade portion to the width of the blade may be in a range of about 0.1 to 1.0, as viewed in circumferential direction, preferably about 0.15 to 0.4, as viewed in circumferential direction.

According to another feature of the present invention, the ratio of the radius of curvature of the blade portion to the outer radius of the blade may be in a range of about 0 to 0.3, preferably about 0.01 to 0.15.

According to another feature of the present invention, the blade portion may have a leading end region, as viewed in the rotation direction, with the end region being constructed to have a flat section and an end section which extends at an angle of about 0° to 45°, preferably about 10° to 30°, to the flat section and is directed away from the blade. Suitably, the end section is substantially triangular in shape. Advantageously, the end section has a radial length, and the blade portion has a radial length, wherein the ratio of the radial length of the end section to the radial length of the blade portion is about 0 to 1.0, preferably about 0.5 to 1.0. Also, the ratio of the width of the end section to the width of the blade portion may be about 0.05 to 0.75, preferably about 0.2 to 0.6.

According to another feature of the present invention, the blade may extend in relation to a rotation plane at an angle in a range of about 10° to 45°, preferably in a range of about 20° to 30°. Suitably, the blade portion extends in relation to the blade at an angle in a range of about 10° to 45°, preferably about 20° to 30°.

According to another feature of the present invention, the blade may have a leading end portion, as viewed in the rotation direction, with the end portion extending at an angle of about 0° to +/−40°, preferably about 0° to +/−15°, to the blade, and being bent to a plane of the blade portion. Suitably, the ratio of the width of the end portion to the width of the blade is about 0 to 0.5, preferably about 0.1 to 0.3.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
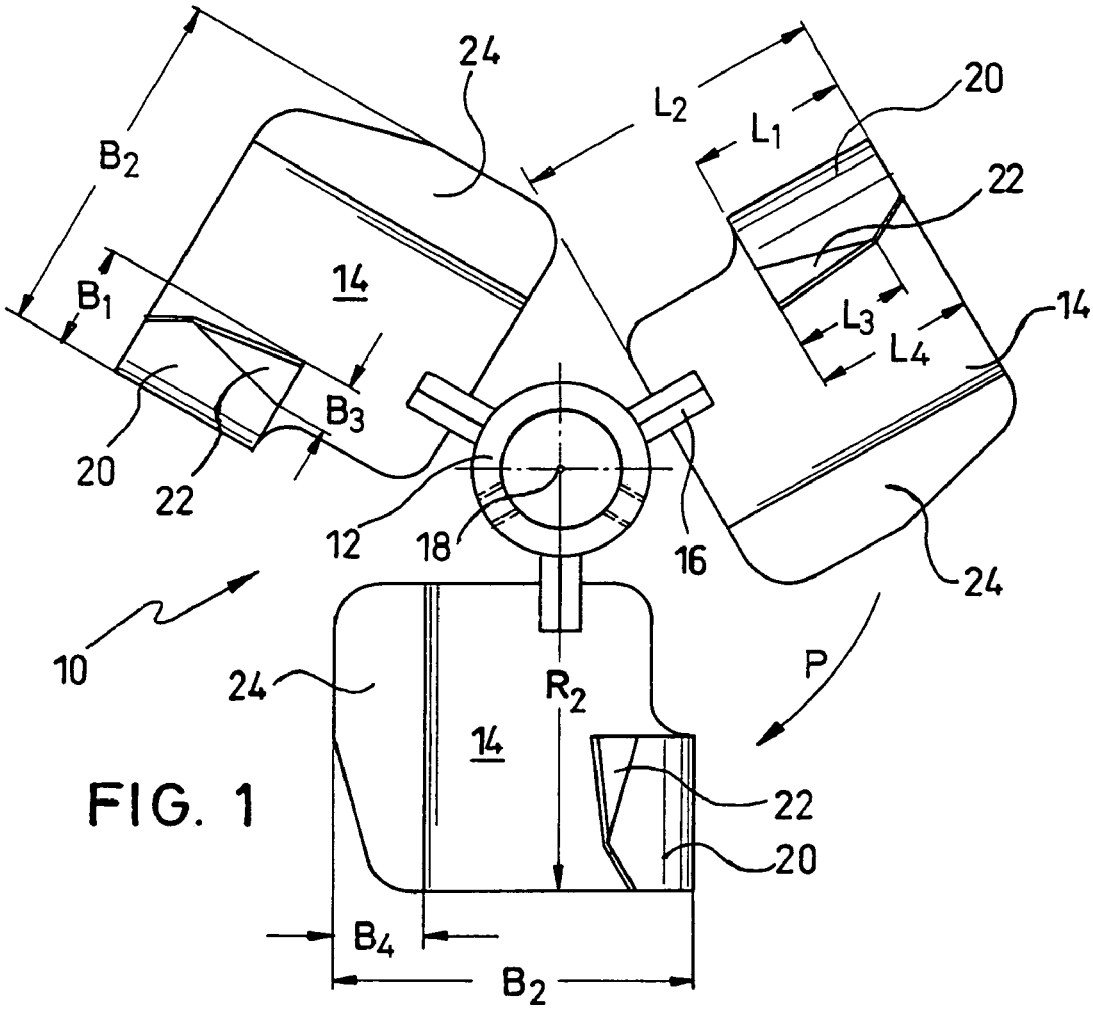
FIG. 1 is a plan view of an agitator according to the present invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a plan view of an agitator according to the present invention, generally designated by reference numeral 10 and including a hub 12 for attaching the agitator 10 to an agitator shaft (not shown). Three mountings 16 are securely fixed about the outer periphery of the hub 12 at an angular distance of 120° for attachment of three blades 14, which extend essentially radially outwardly. Of course, the blades 14 may also be directly mounted to the agitator shaft. In operation, the agitator 10 turns clockwise in a rotation direction of arrow P around an axis 18 which is defined by the agitator shaft. The mountings 16 may extend transversely to the axis 18 or may extend inclined at an acute or obtuse angle in relation to the axis 18.

It will be understood by persons skilled in the art that the illustration of three blades 14 mounted to the hub 12 is by way of example only, as two or more than three blades may, of course, be provided as well.

Reference character R2 designates an outer radius of each blade 14, while reference character L2 designates a total radial length of each blade 14, and reference character B2 designates a total width of each blade 14.

Each blade 14 has in rotation direction a trailing end region which is provided with a blade portion 20 bent forwards in rotation direction and extending radially at a radial length L1 over part of the radial length L2 of the blade 14. The ratio of the radial length L1 of the blade portion 20 to the radial length L2 of the blade 14 is, for example, in a range of about 0.2 to 1.0, preferably in a range of about 0.4 to 0.6. The blade portion 20 has a width B1, whereby the ratio of the width B1, as viewed in circumferential direction, to the width B2 of the blade 14 is, for example, in a range of about 0.1 to 1.0, preferably in a range of about 0.15 to 0.4.

The blade portion 20 is comprised of a curved member 26 having a radius of curvature R1 and terminating in a flat member 28 which, optionally, may also be curved in shape. The ratio of the radius of curvature R1 to the outer radius R2 of the blade 14 is, for example, in a range of about 0 to 0.3, preferably in a range of about 0.01 to 0.15. The blade portion 20 extends from the blade 14 in relation to the vertical rotation axis 18 upwards and then continues substantially forwards in rotation direction of the agitator 10.

Figure 2:
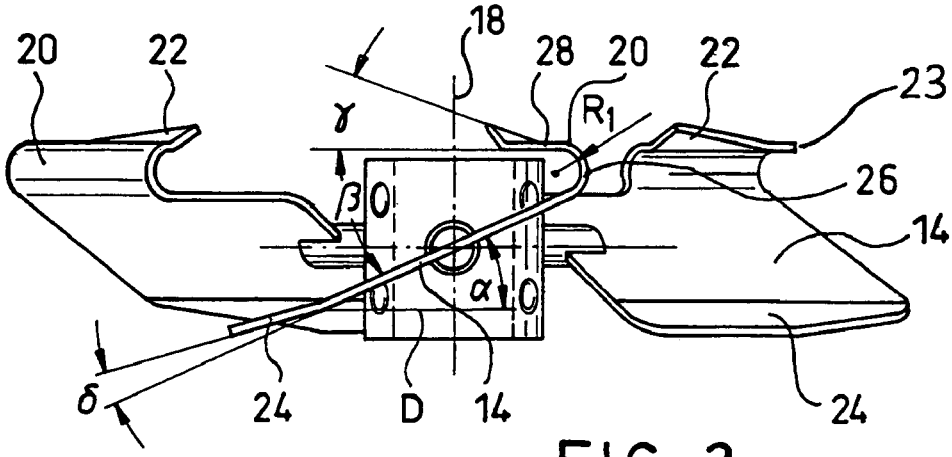
FIG. 2 is a side view of the agitator.

The blade portion 20 of each blade 14 has in rotation direction a leading end region with an end section 22 that may be triangular in shape, as shown by way of example in FIG. 2, and extends at an angle γ to the flat member 28 of the blade portion 20, away from the blade 14. The angle γ may suitably range from about 0° to 45°, preferably, from about 10° to 30°. The triangular end section 22 has a radial length L3 and a width B3 and is configured to have a tip 23, which is directed radially outwards, as shown in FIG. 2. Of course, the tip 23 may also be directed radially inwards. The ratio of the radial length L3 of the triangular end section 22 to the radial length L4 of the blade portion 20 is in the range of about 0 to 1.0, preferably about 0.5 to 1.0. The ratio of the width B3 of the end section 22 to the width B1 of the blade portion 20 is in the range of about 0.05 to 0.75, preferably about 0.2 to 0.6.

As shown in FIG. 2, the blade 14 extends in relation to the rotation plane D at an angle α in the range of about 10° to 45°, preferably, from about 20° to 30°. The flat member 28 of the blade portion 20 extends in relation to the blade 14 at an angle β in the range of about 10° to 45°, preferably about 20° to 30°. As further shown in FIG. 2, the flat member 28 extends in a parallel relationship to a surface of the hub.

Each blade 14 has in rotation direction a leading end which may be configured to have an end portion 24 which is bent at an angle δ in relation to the remainder of the blade 14 to extend in a direction of the plane of the flat member 28 of the blade portion 20. The angle δ may hereby range from about 0° to +/−40°, preferably, from about 0° to +/−15°. The end portion 24 has a width B4, whereby the ratio of the width B4 of the end portion 24 to the total width B2 of the blade 14 ranges suitably from about 0 to 0.5, preferably about 0.1 to 0.3.

The bending line between the blade 14 and the end portion 24 extends in the non-limiting example of the drawing, transversely to the outer edge of the blade 14. Of course, the bending line between the blade 14 and the end portion 24 may, however, extend also at a different angle to the outer edge of the blade 14. The end portion 24 has a front side, as viewed in rotation direction P, which may be rounded and/or beveled, whereby the bevel may suitably be configured in the radially outer zone of the blade 14.

The agitator 10 according to the present invention attains a much shorter mixing time, while still maintaining superior dispersion quality and experiencing little loss in power. As a consequence of the larger area of the blades 14 in relation to the area of the blade portion 20, the radial pump effect is eccentric and has an axial component. The combination of axial and radial flow patterns results is significantly shorter mixing times in the agitator vessel. In view of the substantially box-shaped configuration of the blade portion 20, formation of gas cushions behind the blades 14 is substantially prevented so that power losses during dispersion of gases are reduced. Moreover, compared to axial flow, the implementation of a strong radial flow results in a better heat transport. Thus, the agitator 10 according to the present invention combines the advantages of radially pumping and axially pumping agitators.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An agitator, comprising:

a plurality of blades, with each blade having a trailing end region, which defines a blade portion bent forwards in a rotation direction, and a leading end region, which is bent inwards at an angle in a direction toward the blade portion; and a hub for attachment of the blades and rotation of the blades in the rotation direction, wherein the blade portion is constructed to have a flat section, which extends in a parallel relationship to a surface of the hub, and an end section which extends at an angle to the flat section and is directed outwards away from the leading end region.

2. The agitator of claim 1 for application in the dispersion of gases in liquids.

3. The agitator of claim 1, wherein the blade portion is positioned at a radially outer zone of the blade.

4. The agitator of claim 1, wherein the blade portion has a radial length, and the blade has a radial length, wherein a ratio of the radial length of the blade portion to the radial length of the blade is in a range of about 0.2 to 1.0.

5. The agitator of claim 1, wherein the blade portion has a radial length, and the blade has a radial length, wherein a ratio of the radial length of the blade portion to the radial length of the blade is in a range of about 0.4 to 0.6.

6. The agitator of claim 1, wherein the blade portion has a width, and the blade has a width, wherein a ratio of the width of the blade portion to the width of the blade is in a range of about 0.1 to 1.0, as viewed in circumferential direction.

7. The agitator of claim 1, wherein the blade portion has a width, and the blade has a width, wherein a ratio of the width of the blade portion to the width of the blade is in a range of about 0.15 to 0.4, as viewed in circumferential direction.

8. The agitator of claim 1, wherein the blade portion has a radius of curvature, and the blade has an outer radius, wherein a ratio of the radius of curvature of the blade portion to the outer radius of the blade is in a range of about 0 to 0.3.

9. The agitator of claim 1, wherein the blade portion has a radius of curvature, and the blade has an outer radius, wherein a ratio of the radius of curvature of the blade portion to the outer radius of the blade is in a range of about 0.01 to 0.15.

10. The agitator of claim 1, wherein the end section is substantially triangular in shape.

11. The agitator of claim 1, wherein the angle ranges from about 0° to 45°.

12. The agitator of claim 1, wherein the angle ranges from about 10° to 30°.

13. The agitator of claim 1, wherein the end section has a radial length, and the blade portion has a radial length, wherein a ratio of the radial length of the end section to the radial length of the blade portion is about 0 to 1.0.

14. The agitator of claim 1, wherein the end section has a radial length, and the blade portion has a radial length, wherein a ratio of the radial length of the end section to the radial length of the blade portion is about 0.5 to 1.0.

15. The agitator of claim 1, wherein the end section has a width, and the blade portion has a width, wherein a ratio of the width of the end section to the width of the blade portion is about 0.05 to 0.75.

16. The agitator of claim 1, wherein the end section has a width, and the blade portion has a width, wherein a ratio of the width of the end section to the width of the blade portion is about 0.2 to 0.6.

17. The agitator of claim 1, wherein the blade extends in relation to a rotation plane at an angle in a range of about 10° to 45°.

18. The agitator of claim 1, wherein the blade extends in relation to a rotation plane at an angle in a range of about 20° to 30°.

19. The agitator of claim 1, wherein the blade portion extends in relation to the blade at an angle in a range of about 10° to 45°.

20. The agitator of claim 1, wherein the blade portion extends in relation to the blade at an angle in a range of about 20° to 30°.

21. The agitator of claim 1, wherein the angle ranges from about 0° to +/−40°.

22. The agitator of claim 1, wherein the angle ranges from about 0° to +/−15°.

23. The agitator of claim 1, wherein the leading end region has a width, and the blade has a width, wherein a ratio of the width of the leading end region to the width of the blade is about 0 to 0.5.

24. The agitator of claim 1, wherein the leading end region has a width, and the blade has a width, wherein a ratio of the width of the leading end region to the width of the blade is about 0.1 to 0.3.

* * * * *